United States Patent [19]

Hollier, Jr.

[11] 4,355,771

[45] Oct. 26, 1982

[54] TRANSFER MECHANISM IN THE WINDING OF STOCK MATERIAL

[75] Inventor: Joseph H. Hollier, Jr., Pearcy, Ark.

[73] Assignee: Sutco, Inc., Hot Springs, Ark.

[21] Appl. No.: 158,514

[22] Filed: Jun. 11, 1980

[51] Int. Cl.[3] ..... B65H 19/26

[52] U.S. Cl. ..... 242/56 R; 242/76

[58] Field of Search ..... 242/56 R, 56 A, 75.2, 242/76, 67.1 R, 67.2, 67.3 R, 56.6

[56] References Cited

U.S. PATENT DOCUMENTS

| | | | |
|---|---|---|---|
| 2,537,588 | 1/1951 | Husson | 242/56 R |
| 3,081,014 | 3/1963 | Anderson et al. | 242/75.2 X |
| 3,471,097 | 10/1969 | Phelps | 242/56 R |
| 3,540,969 | 11/1970 | Jorgensen | 242/56 R X |

*Primary Examiner*—John M. Jillions

*Attorney, Agent, or Firm*—George F. Helfrich

[57] ABSTRACT

A device for winding a web of stock material on a spool on a cantilevered support to prepare a package is provided with a guide roll located upstream of the support and in proximity thereto, over the surface of which guide roll the web passes on its way to the package. A resilient strap is anchored in proximity to the guide roll and extends to engage the surface thereof, so that the web is urged by the resilient strap against the surface of the guide roll. A lifter raises the severed end of the web away from the surface of the finished package and supports the severed end in a raised position until the finished package has been removed from the support and a new spool has been placed thereon, whereupon the lifter is lowered so that the severed end is properly positioned in contact with the surface of the new spool for attachment thereto and subsequent commencement of the winding operation.

3 Claims, 3 Drawing Figures

TRANSFER MECHANISM IN THE WINDING OF STOCK MATERIAL

BACKGROUND OF THE INVENTION

1. Field of the Invention

The present invention relates generally to a device for handling stock material. In particular it relates to a transfer mechanism in the winding of stock material, for facilitating the exchange of a wound package of the stock material with a new spool.

2. Prior Art

In the winding of a web of stock material on a cantilevered support to prepare a package, there has been a longstanding need for a simple and efficient transfer mechanism which would facilitate the exchange of a wound package of the stock material with a new spool. It has been particularly desirable to have a transfer mechanism which would: (a) facilitate removal of a finished package after severing of the web therefrom and (b) simultaneously facilitate the proper positioning of the severed end of the web and the subsequent attachment thereof to a new spool which has been placed on the support. Although mechanisms are available for accomplishing such objectives individually, a simple and efficient mechanism for the simultaneous attainment of these objectives has not been available.

SUMMARY OF THE INVENTION

It is accordingly the primary object of the present invention to provide a simple and efficient transfer device which provides for easy removal of a finished package after severing of the web therefrom, at the same time correctly aligning the severed end of the web for the subsequent attachment thereof to a new spool which has been set into position for continuation of the winding operation.

In accordance with the present invention, this object is achieved, and the disadvantages of the prior art are obviated, by providing a device comprising:

(a) a guide roll located upstream of a cantilevered support and in proximity thereto, over the surface of which guide roll a web passes on its way to a package, which is wound on a spool on the support;

(b) a resilient strap anchored in proximity to the guide roll and extending to engage the surface thereof, so that the web is urged by the resilient strap against the surface of the guide roll; and (c) lifting means for raising the severed end of the web away from the surface of the finished package and supporting the severed end of the web in a raised position until the finished package has been removed from the cantilevered support and a new spool has been placed thereon, whereupon the lifting means is lowered so that the severed end of the web is properly positioned in contact with the surface of the new spool for attachment thereto.

Especially advantageous results are achieved when the resilient strap is a steel band. The most beneficial results are obtained when the web of stock material being wound is a cellulosic fiber strip.

BRIEF DESCRIPTION OF THE DRAWING

For a more complete understanding of the present invention, including its primary object and benefits, reference should be made to the detailed description of the preferred embodiments thereof, which is set forth below. This description should be read together with the accompanying drawings, wherein.

DESCRIPTION OF THE PREFERRED EMBODIMENTS

Figure 3:
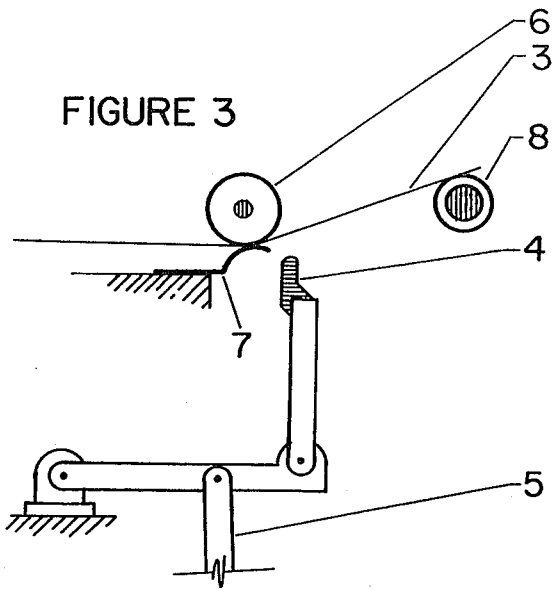
FIG. 3 is a schematic side elevation illustrating the embodiment of FIG. 2 which has returned to the first or rest position of FIG. 1 after replacement of the wound package with a new spool.
Figure 2:
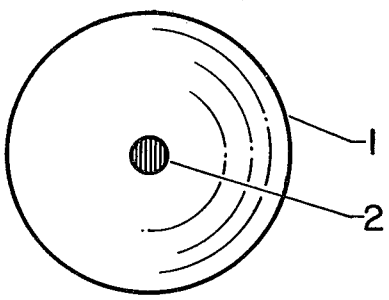
FIG. 2 is a schematic side elevation illustrating the embodiment of FIG. 1 in a second or activated position thereof.
Figure 1:
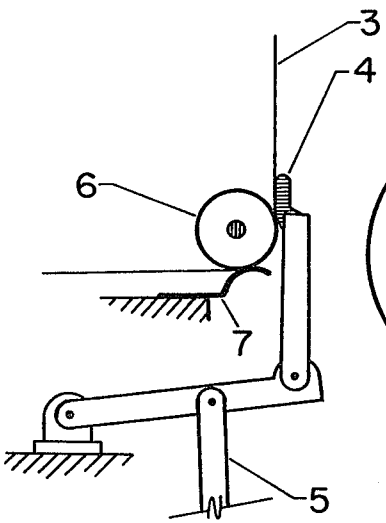
FIG. 1 is a schematic side elevation illustrating a preferred embodiment of the present invention in a first or rest position thereof.
Figure 1:
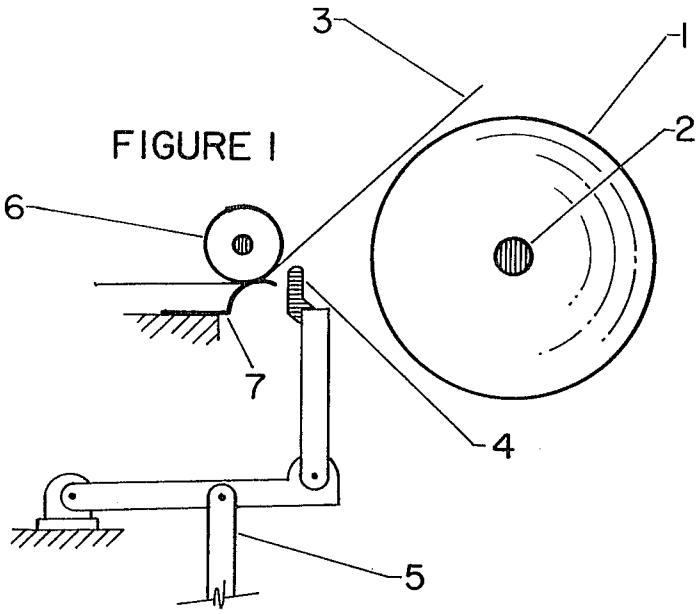

Referring now to the drawings, FIG. 1 shows a web of stock material passing over the surface of guide roll (6) and then being wound into package (1) on a spool mounted on cantilevered support (2). As it is desired to remove finished package (1) from support (2), the web of stock material has been severed from package (1), leaving free end (3) of the web resting on the top of package (1). FIG. 1 shows that guide roll (6), which is located in proximity to cantilevered support (2), is positioned by resilient strap (7), which, anchored nearby, extends to engage the surface of guide roll (6), so that the web is urged by resilient strap (7) against the surface of guide roll (6), over which surface the web passes on its way to form package (1). Lifting means, which is employed to raise the severed end (3) of the web away from the surface of finished package (1), is shown in FIG. 1 in a first or rest position. Such lifting means is seen to comprise bar (4), which is carried by the top arm of a pivot assembly mounted on connecting rod (5). Manual or automatic means is employed to position the lifting means in a second or activated configuration as seen in FIG. 2, whereby bar (4) has raised severed end (3) of the web away from the surface of finished package (1) and supports severed end (3) in such a raised position until finished package (1) can be removed from cantilevered support (2) by manual or mechanical means. Damage to the web is thereby avoided, and finished package (1) is removed quickly and without hindrance. After a new spool (8) has been placed on cantilevered support (2), manual or automatic means is employed to lower the lifting means to its first or rest position, as seen in FIG. 3, whereupon severed end (3) of the web is positioned in contact with the surface of new spool (8) for immediate attachment thereto and subsequent continuance of the winding operation. It is because of the previously described cooperation of guide roll (6) and resilient strap (7) that misalignment of severed end (3) of the web is prevented, and severed end (3) is properly positioned in contact with the surface of new spool (8) for immediate attachment thereto. Avoided hereby is lost time which would be spent in adjusting and aligning severed end (3) for proper attachment to the surface of new spool (8). Especially advantageous results are achieved when resilient strap (7) is a steel band. Under these conditions especially good cooperation with the surface of the guide roll is provided. Moreover, the most beneficial results are achieved when the web of stock material is a cellulosic fiber strip, such as "wallboard tape", which is utilized in the covering and reinforcing of coplanar and corner joints formed by abutting wallboard edges.

While the present invention has been described in detail with respect to certain preferred embodiments thereof, it is understood by those of skill in the art that variations and modifications in this detail may be effected without any departure from the spirit and scope of the present invention, as set forth in the heretoappended claims.

I claim:

1. In a device for winding a web of stock material on a spool on a cantilevered support to prepare a package, the improvement therein for: (a) facilitating removal of a finished package after severing of the web therefrom and (b) facilitating the positioning of the severed end of the web and the subsequent attachment thereof to a new spool which has been placed on the support; the improvement comprising:

(1) a guide roll located upstream of the cantilevered support and in proximity thereto, over the surface of which guide roll the web passes on its way to the package;

(2) a resilient strap anchored in proximity to the guide roll and extending to engage the surface thereof, so that the web is urged by the resilient strap against the surface of the guide roll, over which surface the web passes on its way to the package; and (3) lifting means for raising the severed end of the web away from the surface of the finished package and supporting the severed end of the web in a raised position until the finished package has been removed from the cantilevered support and a new spool has been placed thereon, whereupon the lifting means is lowered so that the severed end of the web is positioned in contact with the surface of the new spool for attachment thereto, and subsequent commencement of the winding operation.

2. The device of claim 1, wherein the resilient strap is a steel band.

3. The device of claim 1, wherein the web of stock material is a cellulosic fiber strip.

* * * * *